US008820413B2

(12) United States Patent
Mathiesen et al.

(10) Patent No.: US 8,820,413 B2
(45) Date of Patent: Sep. 2, 2014

(54) ALTERNATIVE DESIGN OF SELF-ADJUSTING VALVE

(75) Inventors: Vidar Mathiesen, Porsgrunn (NO); Haavard Aakre, Skien (NO)

(73) Assignee: Statoil Petroleum AS, Stavanger (NO)

( * ) Notice: Subject to any disclaimer, the term of this patent is extended or adjusted under 35 U.S.C. 154(b) by 506 days.

(21) Appl. No.: 12/811,430

(22) PCT Filed: Dec. 16, 2008

(86) PCT No.: PCT/NO2008/000454

§ 371 (c)(1), (2), (4) Date: Sep. 20, 2010

(87) PCT Pub. No.: WO2009/088292

PCT Pub. Date: Jul. 16, 2009

(65) Prior Publication Data

US 2011/0017311 A1 Jan. 27, 2011

(30) Foreign Application Priority Data

Jan. 4, 2008 (NO) ..... 2008 0082

(51) Int. Cl.
*E21B 34/08* (2006.01)

(52) U.S. Cl.
USPC ..... 166/373; 166/320; 166/386; 251/282

(58) Field of Classification Search
USPC ..... 166/373, 369, 370, 386, 319, 320, 166/332.1; 137/516.25, 533.19, 859, 137/516.27; 251/282, 324, 325, 12–63.6
See application file for complete search history.

(56) References Cited

U.S. PATENT DOCUMENTS 2,880,959 A * 4/1959 Falconer ..... 251/35
3,319,717 A * 5/1967 Chenoweth ..... 166/115

(Continued)

FOREIGN PATENT DOCUMENTS

GB 2169018 A 7/1986
GB 2 376 488 A 12/2002

(Continued)

OTHER PUBLICATIONS

Dictionary definition of "disk", accessed Oct. 25, 2013 via thefreedictionary.com.*

(Continued)

*Primary Examiner* — Blake Michener
(74) *Attorney, Agent, or Firm* — Birch, Stewart, Kolasch & Birch, LLP

(57) ABSTRACT

A method for flow control and a self-adjusting valve or flow control device, in particular useful in a production pipe for producing oil and/or gas from a well in an oil and/or gas reservoir, which production pipe includes a lower drainage pipe preferably being divided into at least two sections each including one or more inflow control devices which communicates the geological production formation with the flow space of the drainage pipe. The fluid flows through an inlet (10') and further through a flow path of the control device (2) passing by a non-disc shaped movable body (9') which is designed to move relative to the opening of the inlet and thereby reduce or increase the flow-through area (A2) by exploiting the Bernoulli effect and stagnation pressure created over the body (9'), whereby the control device, depending on the composition of the fluid and its properties, automatically adjusts the flow of the fluid based on a pre-estimated flow design.

7 Claims, 7 Drawing Sheets

(56) References Cited

U.S. PATENT DOCUMENTS

| | | | | |
|---|---|---|---|---|
| 3,358,770 | A * | 12/1967 | Zandmer | 166/317 |
| 3,381,749 | A * | 5/1968 | Chenoweth | 166/55 |
| 3,550,616 | A * | 12/1970 | Graham et al. | 137/513.7 |
| 4,577,691 | A | 3/1986 | Huang et al. | |
| 4,791,956 | A * | 12/1988 | Kominami et al. | 137/503 |
| 4,821,801 | A | 4/1989 | Van Laar | |
| 4,858,691 | A | 8/1989 | Ilfrey et al. | |
| 5,265,643 | A * | 11/1993 | Golestan et al. | 137/504 |
| 5,383,489 | A * | 1/1995 | Golestan et al. | 137/504 |
| 5,435,393 | A | 7/1995 | Brekke et al. | |
| 5,529,090 | A * | 6/1996 | Golestan et al. | 137/504 |
| 6,196,259 | B1 * | 3/2001 | Weber | 137/504 |
| 6,237,619 | B1 * | 5/2001 | Maillefer et al. | 137/15.18 |
| 6,289,990 | B1 | 9/2001 | Dillon et al. | |
| 6,786,285 | B2 * | 9/2004 | Johnson et al. | 166/370 |
| 7,296,633 | B2 * | 11/2007 | Bode et al. | 166/386 |
| 7,409,999 | B2 * | 8/2008 | Henriksen et al. | 166/373 |
| 7,600,533 | B2 * | 10/2009 | Tai et al. | 137/516.25 |
| 7,708,074 | B2 * | 5/2010 | AlMubarak | 166/320 |
| 7,900,705 | B2 * | 3/2011 | Patel | 166/319 |
| 8,141,573 | B2 * | 3/2012 | Tai et al. | 137/15.19 |
| 8,336,627 | B2 * | 12/2012 | Patel et al. | 166/325 |
| 2007/0102164 | A1 | 5/2007 | Mackenzie | |
| 2007/0193752 | A1 * | 8/2007 | Kim | 166/386 |
| 2007/0256840 | A1 * | 11/2007 | Aakre | 166/369 |
| 2008/0035875 | A1 * | 2/2008 | Tai et al. | 251/318 |
| 2009/0078428 | A1 * | 3/2009 | Ali | 166/373 |
| 2009/0218103 | A1 * | 9/2009 | Aakre et al. | 166/373 |
| 2011/0011590 | A1 * | 1/2011 | Mathiesen et al. | 166/305.1 |
| 2011/0048732 | A1 * | 3/2011 | Mathiesen et al. | 166/373 |
| 2011/0056578 | A1 * | 3/2011 | Mathiesen et al. | 138/46 |
| 2011/0056700 | A1 * | 3/2011 | Mathiesen et al. | 166/369 |
| 2011/0067878 | A1 * | 3/2011 | Aadnoy | 166/321 |

FOREIGN PATENT DOCUMENTS

| | | | |
|---|---|---|---|
| WO | WO 92/08875 | A2 | 5/1992 |
| WO | WO 98/20231 | A | 5/1998 |
| WO | WO 2005/080750 | A | 9/2005 |
| WO | 2008/00487 | A1 | 1/2008 |

OTHER PUBLICATIONS

White et al., "Controlling Flow in Horizontal Wells," World Oil, Nov. 1991, pp. 73-80 with 1 page attachment.

* cited by examiner

ALTERNATIVE DESIGN OF SELF-ADJUSTING VALVE

The present invention relates to method for self-adjusting (autonomously adjusting) the flow of a fluid through a valve or flow control device, and a self adjusting valve or flow control device, in particular useful in a production pipe for producing oil and/or gas from a well in an oil and/or gas reservoir, which production pipe includes a lower drainage pipe preferably being divided into at least two sections each including one or more inflow control devices which communicates the geological production formation with the flow space of the drainage pipe.

More particularly, the invention relates to an improvement of the applicant's method for flow control and autonomous valve or flow control device as described in Norwegian patent application No. 20063181 withdrawn before publication and in International application No. PCT/NO2007/000204 claiming priority from NO 20063181 and which is not yet published at the date of filing of the present application.

Devices for recovering of oil and gas from long, horizontal and vertical wells are known from US patent publications Nos. 4,821,801, 4,858,691, 4,577,691 and GB patent publication No. 2169018. These known devices comprise a perforated drainage pipe with, for example, a filter for control of sand around the pipe. A considerable disadvantage with the known devices for oil/and or gas production in highly permeable geological formations is that the pressure in the drainage pipe increases exponentially in the upstream direction as a result of the flow friction in the pipe. Because the differential pressure between the reservoir and the drainage pipe will decrease upstream as a result, the quantity of oil and/or gas flowing from the reservoir into the drainage pipe will decrease correspondingly. The total oil and/or gas produced by this means will therefore be low. With thin oil zones and highly permeable geological formations, there is further a high risk that of coning, i. e. flow of unwanted water or gas into the drainage pipe downstream, where the velocity of the oil flow from the reservoir to the pipe is the greatest.

From World Oil, vol. 212, N. 11 (11/91), pages 73-80, is previously known to divide a drainage pipe into sections with one or more inflow restriction devices such as sliding sleeves or throttling devices. However, this reference is mainly dealing with the use of inflow control to limit the inflow rate for up hole zones and thereby avoid or reduce coning of water and or gas.

WO-A-9208875 describes a horizontal production pipe comprising a plurality of production sections connected by mixing chambers having a larger internal diameter than the production sections. The production sections comprise an external slotted liner which can be considered as performing a filtering action. However, the sequence of sections of different diameter creates flow turbulence and prevent the running of work-over tools.

When extracting oil and or gas from geological production formations, fluids of different qualities, i.e. oil, gas, water (and sand) is produced in different amounts and mixtures depending on the property or quality of the formation. None of the above-mentioned, known devices are able to distinguish between and control the inflow of oil, gas or water on the basis of their relative composition and/or quality.

With the present invention is provided an inflow control device which is self adjusting or autonomous and can easily be fitted in the wall of a production pipe and which therefore provide for the use of work-over tools. The device is designed to "distinguish" between the oil and/or gas and/or water and is able to control the flow or inflow of oil or gas, depending on which of these fluids such flow control is required.

The device as disclosed in NO 20063181 and PCT/NO2007/000204 is robust, can withstand large forces and high temperatures, prevents draw dawns (differential pressure), needs no energy supply, can withstand sand production, is reliable, but is still simple and very cheap. However, several improvements might nevertheless be made to increase the performance and longevity of the above device in which at least the different embodiments of NO 20063181 and PCT/NO2007/000204 describe a disc as the movable body of the valve.

One potential problem with a disc as the movable body is erosion on the movable body. This is due to a very large velocity between the inner seat and the movable body of the valve. The fluid changes its flow direction by 90 degrees upstream of this location and there will always be a significant amount of particles in the fluid flow even if sand screens are installed, which cause the erosion. The erosion problem exists both with and without the use of a stagnation chamber in the valve, and with the present invention also the flow characteristic will be improved.

The method according to the present invention is characterized in that the fluid flows through an inlet or aperture thereby forming a flow path through the control device passing by a non-disc shaped movable body which is designed to move freely relative to the opening of the inlet and thereby reduce or increase the flow-through area by exploiting the Bernoulli effect and any stagnation pressure created over said body, whereby the control device, depending on the composition of the fluid and its properties, autonomously adjusts the flow of the fluid based on a pre-estimated flow design, as defined in the characterizing portion of the independent claim 1.

The self-adjusting valve or control device according to the present invention is characterized in that the control device is a separate or integral part of the fluid flow control arrangement, including a freely movable non-disc shaped controlling body being provided in a recess of the pipe wall or being provided in a separate housing body in the wall, the controlling body facing the outlet of an aperture or hole in the centre of the recess or housing body and being held in place in the recess or housing body by means of a holder device or arrangement, thereby forming a flow path where the fluid enters the control device through the central aperture or inlet flowing towards and along the disc or body and out of the recess or housing, as defined in the characterizing portion of the independent claim 5.

Dependent claims 2-4 and 6-7 define preferred embodiments of the invention.

The present invention will be further described in the following by means of examples and with reference to the drawings, where:

Figure 1:
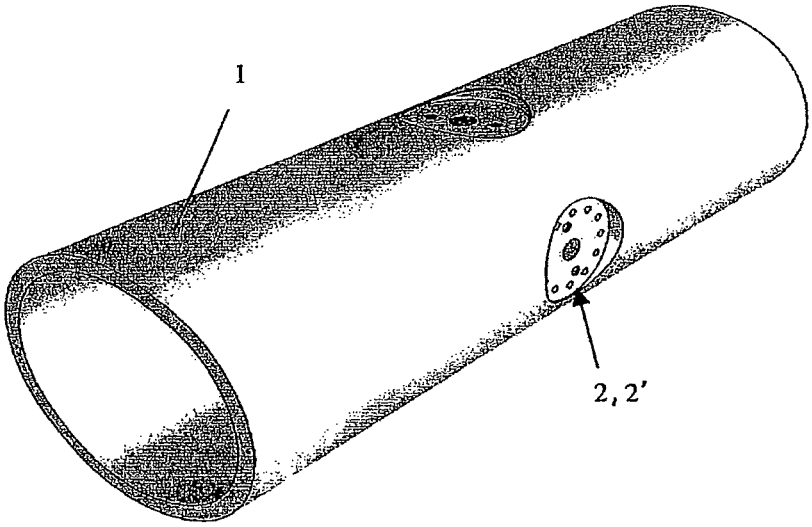
Fig. 1 PRIOR ART
FIG. 1 shows a schematic view of a production pipe with a control device according to PCT/NO2007/000204 or the present invention, FIG. 2*a*) shows, in larger scale, a cross section of the control device according to PCT/NO2007/000204, *b*) shows the same device in a top view.

In the following description an apostrophe sign (') is used after reference numerals in order to differ similar or equal features of the improved control device according to the present invention from the prior control device according to PCT/NO2007/000204.

FIG. 1 shows, as stated above, a section of a production pipe 1 in which a prototype of a control device 2, 2' according to PCT/NO2007/000204 or the present invention is provided. The control device 2, 2' is preferably of circular, relatively flat shape and may be provided with external threads 3 (see FIG. 2) to be screwed into a circular hole with corresponding internal threads in the pipe. By controlling the thickness, the device 2, 2' may be adapted to the thickness of the pipe and fit within its outer and inner periphery.

FIGS. 2*a*) and *b*) shows the prior control device 2 of PCT/NO2007/000204 in larger scale. The device consists of a first disc-shaped housing body 4 with an outer cylindrical segment 5 and inner cylindrical segment 6 and with a central hole or aperture 10, and a second disc-shaped holder body 7 with an outer cylindrical segment 8, as well as a preferably flat disc or freely movable body 9 provided in an open space 14 formed between the first 4 and second 7 disc-shaped housing and holder bodies. The body 9 may for particular applications and adjustments depart from the flat shape and have a partly conical or semicircular shape (for instance towards the aperture 10.) As can be seen from the figure, the cylindrical segment 8 of the second disc-shaped holder body 7 fits within and protrudes in the opposite direction of the outer cylindrical segment 5 of the first disc-shaped housing body 4 thereby forming a flow path as shown by the arrows 11, where the fluid enters the control device through the central hole or aperture (inlet) 10 and flows towards and radially along the disc 9 before flowing through the annular opening 12 formed between the cylindrical segments 8 and 6 and further out through the annular opening 13 formed between the cylindrical segments 8 and 5. The two disc-shaped housing and holder bodies 4, 7 are attached to one another by a screw connection, welding or other means (not further shown in the figures) at a connection area 15 as shown in FIG. 2*b*).

The present invention exploits the effect of Bernoulli teaching that the sum of static pressure, dynamic pressure and friction is constant along a flow line:

$$P_{static} + \frac{1}{2}\rho v^2 + \Delta p_{friction}$$

When subjecting the disc 9 to a fluid flow, which is the case with the present invention, the pressure difference over the disc 9 can be expressed as follows:

$$\Delta p_{over} = [p_{over(P_4)} - p_{under(f(p_1,p_2,p_3))}] = \frac{1}{2}\rho v^2$$

Due to lower viscosity, a fluid such as gas will "make the turn later" and follow further along the disc towards its outer end (indicated by reference number 14). This makes a higher stagnation pressure in the area 16 at the end of the disc 9, which in turn makes a higher pressure over the disc. And the disc 9, which is freely movable within the space between the disc-shaped bodies 4, 7, will move downwards and thereby narrow the flow path between the disc 9 and inner cylindrical segment 6. Thus, the disc 9 moves dawn-wards or up-wards depending on the viscosity of the fluid flowing through, whereby this principle can be used to control (close/open) the flow of fluid through of the device.

Figure 3:
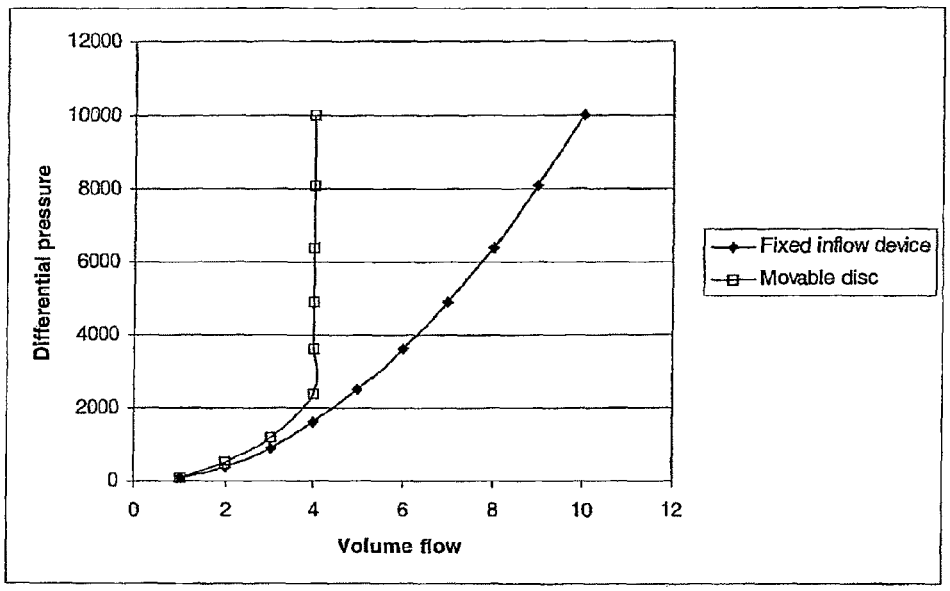
FIG. 3 is a diagram showing the flow volume through a control device according to the invention vs. the differential pressure in comparison with a fixed inflow device.

Further, the pressure drop through a traditional inflow control device (ICD) with fixed geometry will be proportional to the dynamic pressure:

$$\Delta p = K \cdot \frac{1}{2}\rho v^2$$

where the constant, K is mainly a function of the geometry and less dependent on the Reynolds number. In the control device according to the present invention the flow area will decrease when the differential pressure increases, such that the volume flow through the control device will not, or nearly not, increase when the pressure drop increases. A comparison between a control device according to the present invention with movable disc and a control device with fixed flow-through opening is shown in FIG. 3, and as can be seen from the figure, the flow-through volume for the present invention is constant above a given differential pressure.

This represents a major advantage with the present invention as it can be used to ensure the same volume flowing through each section for the entire horizontal well, which is not possible with fixed inflow control devices.

Figure 4:
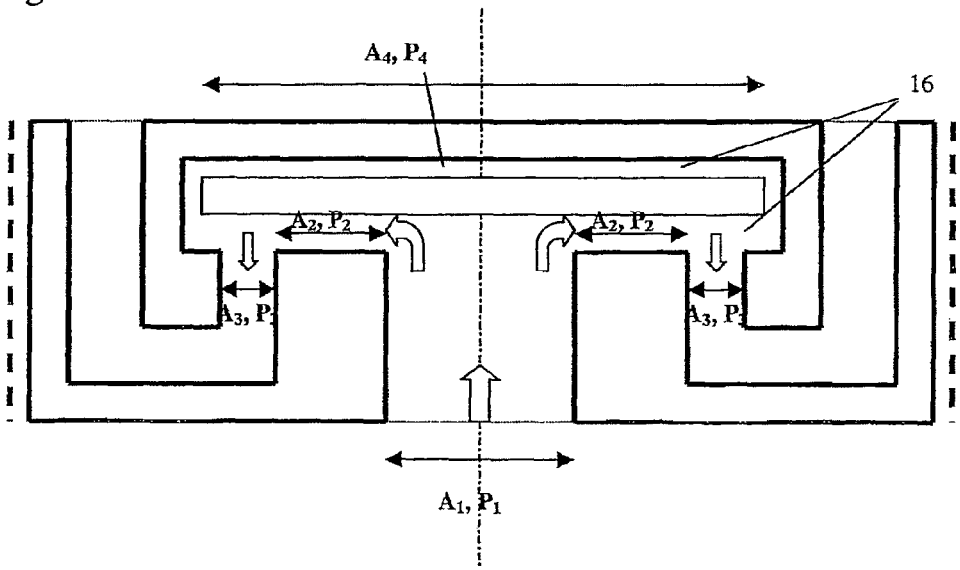
Fig. 4 PRIOR ART
FIG. 4 shows the device shown in FIG. 2, but with the indication of different pressure zones influencing the design of the device for different applications.

When producing oil and gas the control device according to the invention may have two different applications: Using it as inflow control device to reduce inflow of water, or using it to reduce inflow of gas at gas break through situations. When designing the control device according to the invention for the different application such as water or gas, as mentioned above, the different areas and pressure zones, as shown in FIG. 4, will have impact on the efficiency and flow through properties of the device. Referring to FIG. 4, the different area/pressure zones may be divided into:

- $A_1$, $P_1$ is the inflow area and pressure respectively. The force ($P_1 \cdot A_1$) generated by this pressure will strive to open the control device (move the disc or body 9 upwards).
- $A_2$, $P_2$ is the area and pressure in the zone where the velocity will be largest and hence represents a dynamic pressure source. The resulting force of the dynamic pressure will strive to close the control device (move the disc or body 9 downwards as the flow to velocity increases).
- $A_3$, $P_3$ is the area and pressure at the outlet. This should be the same as the well pressure (inlet pressure).
- $A_4$, $P_4$ is the area and pressure (stagnation pressure) behind the movable disc or body 9. The stagnation pressure, at position 16 (FIG. 2), creates the pressure and the force behind the body. This will strive to close the control device (move the body downwards). The area behind the body 9, at position 16, thus constitutes a stagnation chamber.

Fluids with different viscosities will provide different forces in each zone depending on the design of these zones. In order to optimize the efficiency and flow through properties of the control device, the design of the areas will be different for different applications, e.g. gas/oil or oil/water flow. Hence, for each application the areas needs to be carefully balanced and optimally designed taking into account the properties and physical conditions (viscosity, temperature, pressure etc.) for each design situation.

Figure 2:
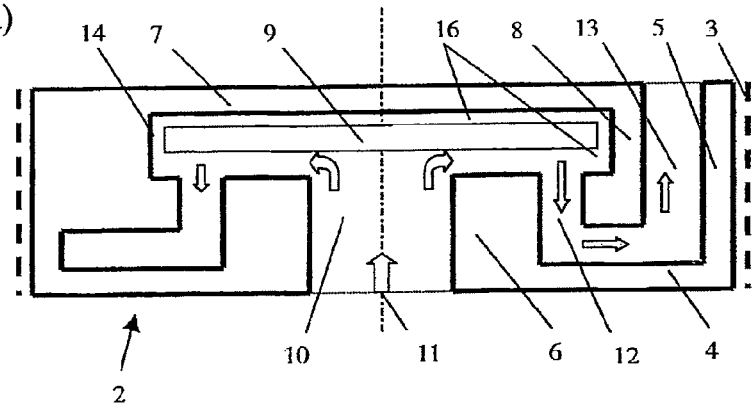
Fig. 2 a) PRIOR ART
Figure 2:
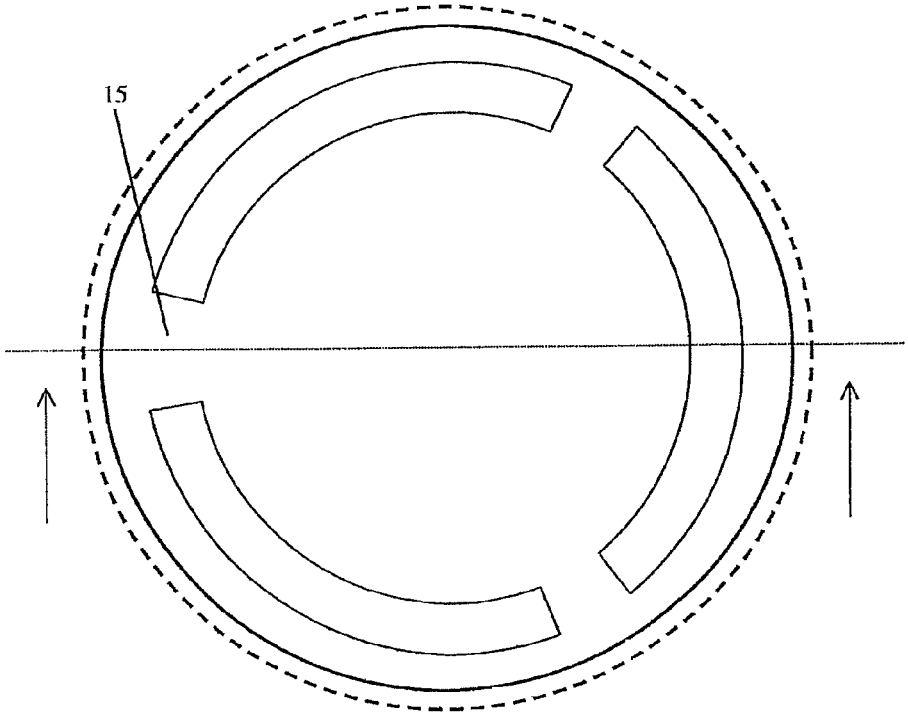
Fig. 2 b) PRIOR ART
Figure 5:
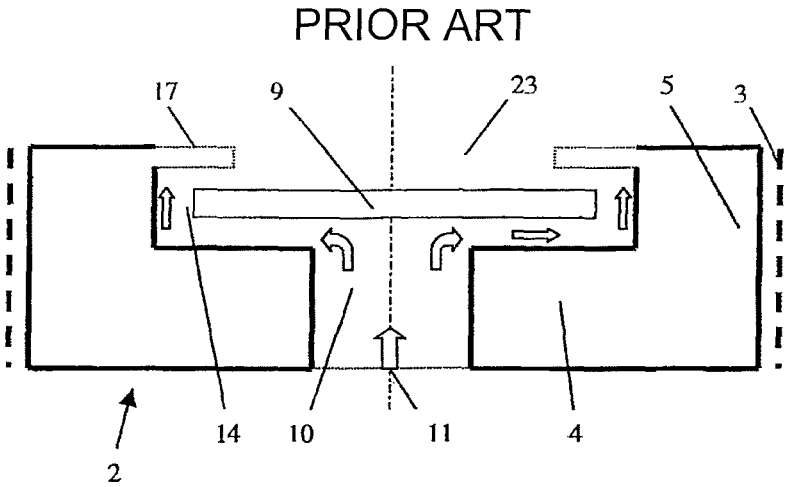
FIG. 5 shows a principal sketch of another embodiment of the control device according to PCT/NO2007/000204.

FIG. 5 shows a principal sketch of another embodiment of the control device according PCT/NO2007/000204, which is of a more simple design than the version shown in FIG. 2. The control device 2 consists, as with the version shown in FIG. 2, of a first disc-shaped housing body 4 with an outer cylindrical segment 5 and with a central hole or aperture 10, and a second disc-shaped holder body 17 attached to the segment 5 of the housing body 4, as well as a preferably flat disc 9 provided in an open space 14 formed between the first and second disc-shaped housing and holder bodies 4, 17. However, since the second disc-shaped holder body 17 is inwardly open (through a hole or holes 23, etc.) and is now only holding the disc in place, and since the cylindrical segment 5 is shorter with a different flow path than what is shown in FIG. 2, there is no build up of stagnation pressure ($P_4$) on the back side of the disc 9 as explained above in conjunction with FIG. 4. With this solution without stagnation pressure the building thickness for the device is lower and may withstand a larger amount of particles contained in the fluid.

Figure 6:
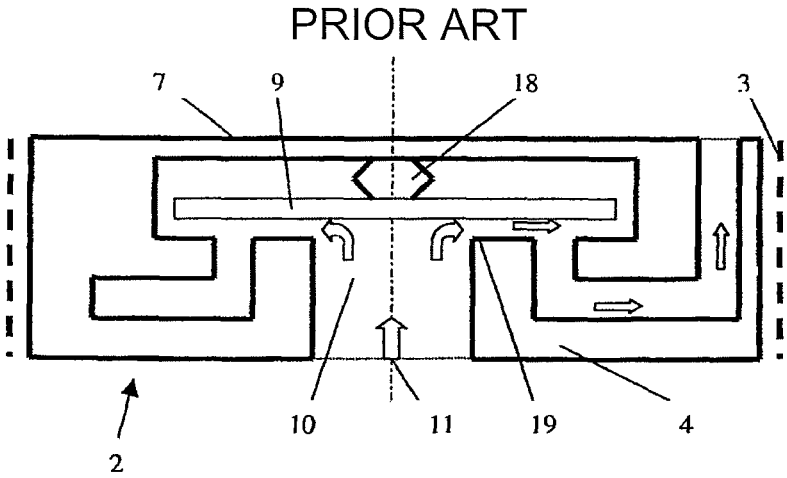
FIG. 6 shows a principal sketch of a third embodiment of the control device according to PCT/NO2007/000204.

FIG. 6 shows a third embodiment according to PCT/NO2007/000204 where the design is the same as with the example shown in FIG. 2, but where a spring element 18, in the form of a spiral or other suitable spring device, is provided on either side of the disc and connects the disc with the holder 7, 22, recess 21 or housing 4.

The spring element 18 is used to balance and control the inflow area between the disc 9 and the inlet 10, or rather the surrounding edge or seat 19 of the inlet 10. Thus, depending on the spring constant and thereby the spring force, the opening between the disc 9 and edge 19 will be larger or smaller, and with a suitable selected spring constant, depending on the inflow and pressure conditions at the selected place where the control device is provided, constant mass flow through the device may be obtained.

Figure 7:
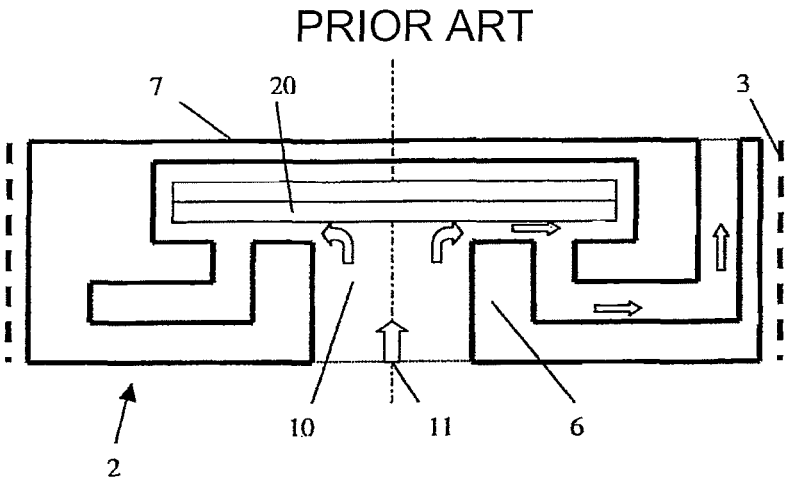
FIG. 7 shows a principal sketch of a fourth embodiment of the control device according to PCT/NO2007/000204.

FIG. 7 shows a fourth embodiment according to PCT/NO2007/000204, where the design is the same as with the example in FIG. 6 above, but where the disc 9 is, on the side facing the inlet opening 10, provided with a thermally responsive device such as bi-metallic element 20.

When producing oil and/or gas the conditions may rapidly change from a situation where only or mostly oil is produced to a situation where only or mostly gas is produced (gas break-through or gas coning). With for instance a pressure drop of 16 bar from 100 bar the temperature drop would correspond to approximately 20° C. By providing the disc 9 with a thermally responsive element such as a bi-metallic element as shown in FIG. 7, the disc will bend upwards or be moved upwards by the element 20 abutting the holder shaped body 7 and thereby narrowing the opening between the disc and the inlet 10 or fully closing said inlet.

Figure 8:
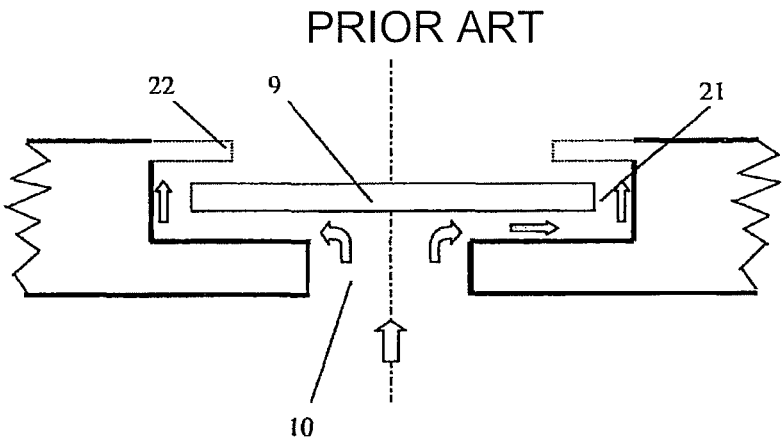
FIG. 8 shows a principal sketch of a fifth embodiment of PCT/NO2007/000204 where the control device is an integral part of a flow arrangement.

The above prior examples of a control device as shown in FIGS. 1 and 2 and 4-7 are all related to solutions where the control device as such is a separate unit or device to be provided in conjunction with a fluid flow situation or arrangement such as the wall of a production pipe in connection with the production of oil and gas. However, the control device may, as shown in FIG. 8, be an integral part of the fluid flow arrangement, whereby the movable body 9 may be provided in a recess 21 facing the outlet of an aperture or hole 10 of for instance a wall of a pipe 1 as shown in FIG. 1 instead of being provided in a separate housing body 4. Further, the movable body 9 may be held in place in the recess by means of a holder device such as inwardly protruding spikes, a circular ring 22 or the like being connected to the outer opening of the recess by means of screwing, welding or the like.

Figure 9:
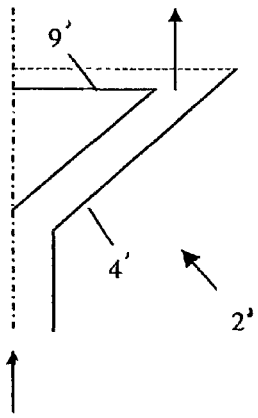
FIG. 9 shows a principal sketch of a first embodiment of the improved control device according to the present invention.
Figure 10:
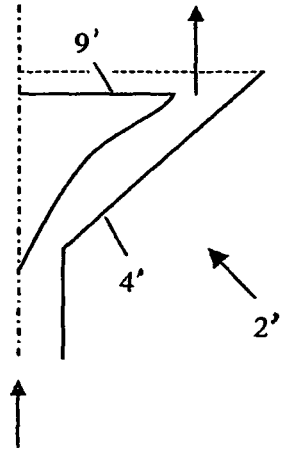
FIG. 10 shows a principal sketch of a second embodiment of the control device according to the present invention.
Figure 11:
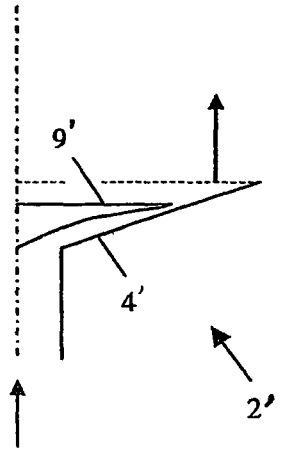
FIG. 11 shows a principal sketch of a third embodiment of the control device according to the present invention.

FIGS. 9, 10 and 11 show a first, a second and a third embodiment, respectively, of the improved control device 2' according to the present invention in which the movable body 9' has a non-disc shape or design. As apparent from said figures, only one (the right) side of the control device 2' along a longitudinal symmetry line is shown. In FIG. 9 the body 9' has a fully conical shape, in FIG. 10 the body 9' has a tapering shape and in FIG. 11 the body 9' has another tapering shape in which only the upper perimetric part of the body 9' will contact the housing 4' in a seated position of the body 9'. Other shapes, or combination of shapes, of the body 9', e.g. hemispheric, are also conceivable.

Figure 12:
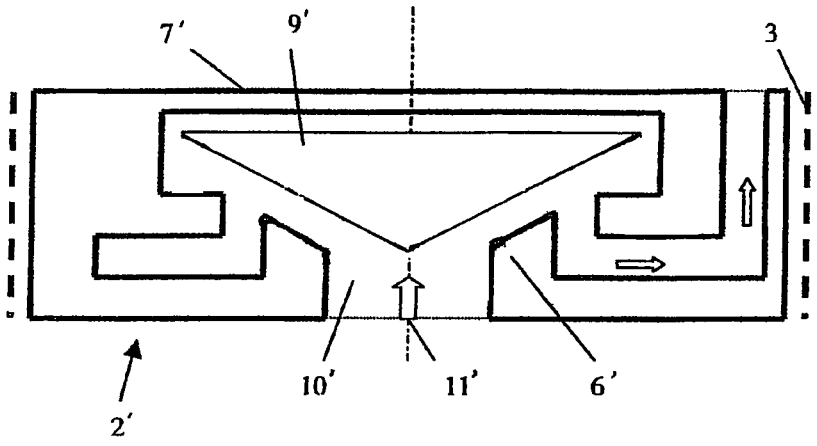
FIG. 12 shows a principal sketch of a fourth embodiment of the control device according to the present invention.

FIG. 12 shows a control device 2' in accordance with the invention in which a stagnation chamber 16' is provided behind the movable body 9' of FIG. 9. However, a stagnation chamber does not have to be provided according to the invention, and in such cases a holder arrangement (not shown) similar with the holder 22 arrangement of the prior embodiment shown in FIG. 8 might be provided.

The present invention as defined in the claims is not restricted to the application related to inflow of oil and/or gas from a well as described above or when injecting gas (natural gas, air or $CO_2$), steam or water into an oil and/or gas producing well. Thus, the invention may be used in any processes or process related application where the flow of fluids with different gas and/or liquid compositions needs to be controlled.

The invention claimed is:

1. A method for autonomously adjusting the flow of a fluid through a valve or flow control device into a production pipe of a well in a hydrocarbon reservoir, said method comprising the steps of:

flowing the fluid through an inlet of the valve or the flow control device so as to form a flow path through the valve or the flow control device passing by an un-biased freely movable tapering shaped body which is designed to move freely relative to the inlet and thereby reduce or increase a flow-through area of the valve or the flow control device, wherein the inlet is substantially aligned with a longitudinal axis of the tapering shaped body, and a flow of the fluid over a surface of the tapering shaped body is radially offset from the longitudinal axis of the tapering shaped body, wherein the tapering shaped body is moved with a force due to a fluid pressure difference between opposite sides of the tapering shaped body, the fluid pressure difference being created according to the Bernoulli effect and any stagnation pressure created over the tapering shaped body, whereby the flow control device, depending on the composition of the fluid and its properties, autonomously adjusts the flow of the fluid based on a pre-estimated flow design.

2. The method in accordance with claim 1, wherein the fluid comprises any of water, oil, natural gas, produced gas and $CO_2$.

3. The method in accordance with claim 2, wherein the tapering body has a conical or hemispheric shape.

4. The method in accordance with claim 1, wherein the tapering shaped body has a conical or hemispheric shape.

5. A self-adjustable autonomous valve or flow control device for controlling the flow of a fluid into a hydrocarbon reservoir, wherein the flow control device includes an un-biased freely movable tapering shaped controlling body being provided in a recess of a wall of a production pipe of a well or being provided in a separate housing body, said movable tapering shaped controlling body is arranged to form a flow path where the fluid enters the flow control device through an inlet flowing towards and along the tapering shaped controlling body and out of the recess or housing, wherein the inlet is substantially aligned with a longitudinal axis of the tapering shaped body, and a flow of the fluid over a surface of the tapering shaped body is radially offset from the longitudinal axis of the tapering shaped body, and the tapering shaped controlling body is movable with a force due to a fluid pressure difference between opposite sides of the tapering shaped controlling body, the fluid pressure difference being created according to the Bernoulli effect and any stagnation pressure created over the tapering shaped controlling body.

6. The self-adjustable valve or flow control device according to claim 5, wherein the tapering shaped body has a conical or hemispheric shape.

7. The self-adjustable valve or flow control device according to claim 5, wherein the valve or flow control device comprises a stagnation chamber behind the tapering shaped body.

* * * * *